US011276332B2

(12) United States Patent
Miller

(10) Patent No.: US 11,276,332 B2
(45) Date of Patent: Mar. 15, 2022

(54) DISPLAY DEVICES AND METHODS FOR USING SAME

(71) Applicant: Vendii LLC, Kennesaw, GA (US)

(72) Inventor: Chris Miller, Kennesaw, GA (US)

(73) Assignee: Vendii LLC, Kennesaw, GA (US)

( * ) Notice: Subject to any disclaimer, the term of this patent is extended or adjusted under 35 U.S.C. 154(b) by 7 days.

(21) Appl. No.: 16/670,331

(22) Filed: Oct. 31, 2019

(65) Prior Publication Data

US 2020/0135061 A1 Apr. 30, 2020

Related U.S. Application Data

(60) Provisional application No. 62/752,699, filed on Oct. 30, 2018.

(51) Int. Cl.

| | |
|---|---|
| ***G09F 7/18*** | (2006.01) |
| ***G09F 23/06*** | (2006.01) |
| ***G09F 3/20*** | (2006.01) |
| ***A47F 3/04*** | (2006.01) |
| ***G09F 7/10*** | (2006.01) |

(52) U.S. Cl.

CPC ..... *G09F 7/18* (2013.01); *A47F 3/0434* (2013.01); *G09F 3/204* (2013.01); *G09F 7/10* (2013.01); *G09F 23/065* (2013.01); *G09F 2007/1856* (2013.01)

(58) Field of Classification Search

CPC ..... G09F 7/18; G09F 23/065; G09F 3/204; G09F 7/10; G09F 2007/1856; A47F 3/0434

See application file for complete search history.

(56) References Cited

U.S. PATENT DOCUMENTS

| | | | | |
|---|---|---|---|---|
| 4,682,430 | A * | 7/1987 | Ramsay | G09F 7/02 40/490 |
| 4,698,928 | A | 10/1987 | Soporowski | |
| 5,233,773 | A * | 8/1993 | Reynolds | G09F 3/18 248/289.31 |
| 5,331,758 | A | 7/1994 | Romick | |
| 5,392,547 | A | 2/1995 | Mason | |
| 6,266,906 | B1 * | 7/2001 | Nagel | G09F 3/204 40/649 |
| 6,568,113 | B1 * | 5/2003 | Valiulis | G09F 3/204 40/653 |
| 8,671,603 | B2 | 3/2014 | Garfinkle | |
| 9,038,300 | B2 | 5/2015 | Theisen et al. | |
| 2002/0178630 | A1 | 12/2002 | Valiulis | |

(Continued)

FOREIGN PATENT DOCUMENTS

CA 2842974 A1 4/2014

*Primary Examiner* — Cassandra Davis
(74) *Attorney, Agent, or Firm* — Bekiares Eliezer LLP

(57) ABSTRACT

Disclosed herein are display devices and systems including a collapsible display assembly: the assembly having a plurality of panels having a predetermined area and thickness, the plurality of panels connected using a plurality of living hinges; a plurality of posts connected to at least one panel; a plurality of protrusions disposed on at least one surface of at least one panel, the protrusions configured to limit a range of motion of at least one living hinge. Also disclosed herein are methods of using the disclosed display devices and systems, for example, to display information in a vending machine, such as pricing and/or caloric information.

20 Claims, 13 Drawing Sheets

(56) References Cited

U.S. PATENT DOCUMENTS

| | | | | |
|---|---|---|---|---|
| 2005/0166438 | A1* | 8/2005 | Mueller | G09F 3/204 40/661.03 |
| 2014/0196335 | A1 | 7/2014 | Barkdoll et al. | |

* cited by examiner

DISPLAY DEVICES AND METHODS FOR USING SAME

CROSS REFERENCE TO RELATED APPLICATION

This application claims the benefit of priority to U.S. Provisional Application No. 62/752,699, filed Oct. 30, 2018, which is hereby incorporated by reference herein in its entirety.

It is intended that the above-referenced application may be applicable to the concepts and embodiments disclosed herein, even if such concepts and embodiments are disclosed in the referenced applications with different limitations and configurations and described using different examples and terminology.

FIELD OF INVENTION

The present invention relates to display devices, and systems and methods for using the devices, for example, in vending machines.

BACKGROUND OF THE INVENTION

The need for displays on vending machines that are dynamic and versatile is increasing. With new FDA regulations and requirements for calories and other nutritional facts to be displayed alongside the price of each item, devices for displaying this information are outdated, inefficient, and wasteful. Current vending machine labeling methods are static and do not address the need to display both caloric and pricing information.

SUMMARY OF THE INVENTION

In accordance with the purposes of the invention, as embodied and broadly described herein, the invention, in one aspect, relates to display devices and systems, such as, for example, for use in connection with a vending machine. In further aspects, the device can comprise: a collapsible display assembly, the assembly comprising a hinged base member having plurality of panels having a predetermined or desired area and thickness, the plurality of panels connected using a plurality of living hinges; a plurality of posts connected to at least one panel; a plurality of protrusions disposed on at least one surface of at least one panel, the protrusions configured to limit a range of motion of at least one living hinge. In an exemplary aspect, a plurality of side flaps can configure to attach, using an attaching feature, connector, or fastener, to at least one surface of a panel, wherein the side flaps are configured to retain the assembly within a display channel.

In further aspects, the invention relates to systems comprising the display devices.

In yet further aspects, the invention relates to methods for using the disclosed devices and systems, for example, for displaying caloric and pricing information in a vending machine.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
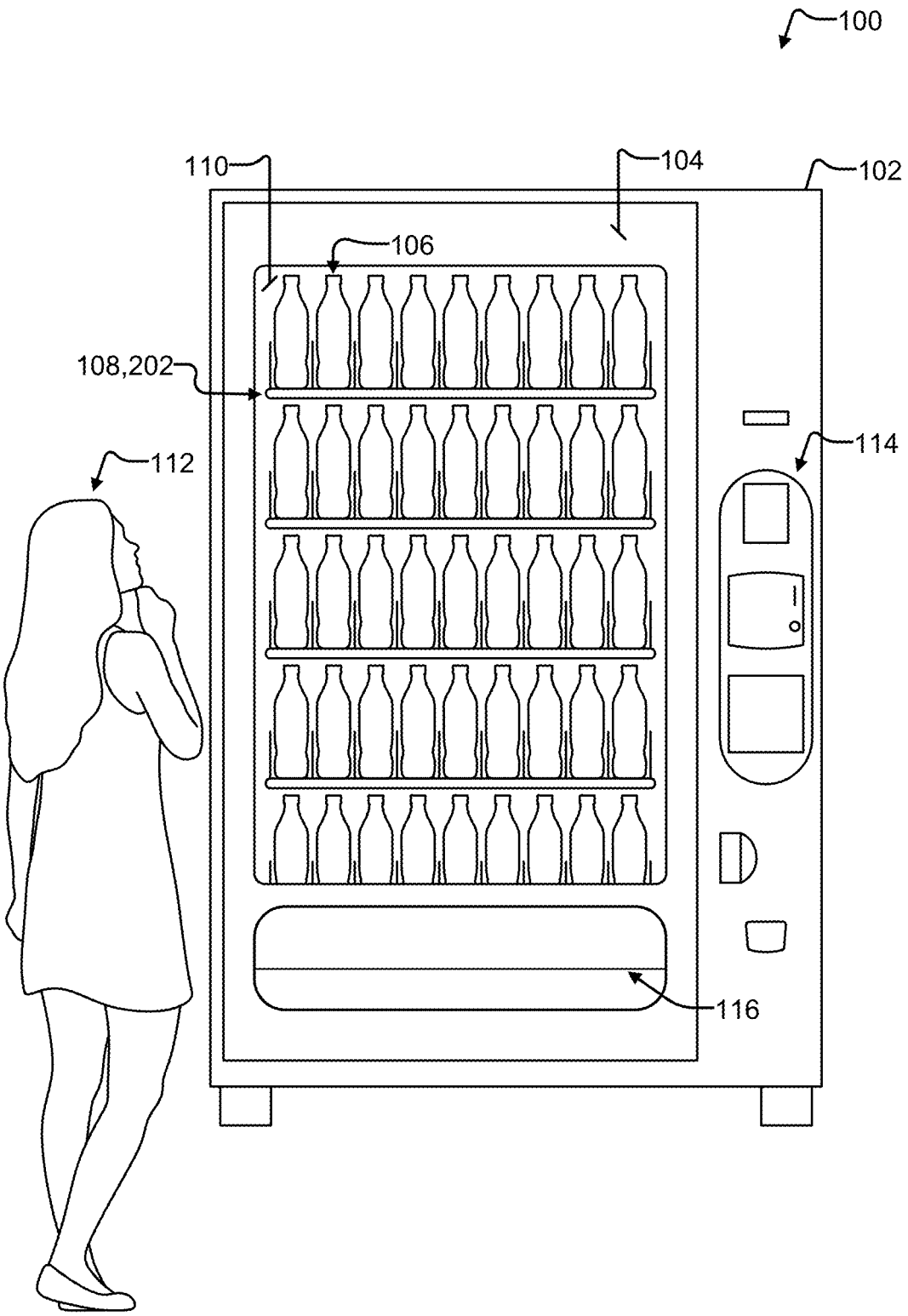
FIG. 1 depicts a vending machine system equipped with display assemblies, according to example embodiments of the present disclosure.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

The term "substantially" as used herein can be applied to modify any quantitative representation which could permissibly vary without resulting in a change in the basic function to which it is related. For example, the term "substantially planar" is intended to refer to a shape wherein a component or object is flat relative to perfectly flat surface, for example from about 80% to about 100% planar, e.g., 85%, 90%, 95%, 97%, 99%.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the invention as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

As briefly described above, the present disclosure relates, in various aspects, to display devices and systems, for example, for use in connection with vending machines. In one aspect, disclosed herein is a display device comprising at least one collapsible display assembly. In further aspects, an assembly comprises a hinged base member having a plurality of panels, the panels having predetermined or desired area and thickness. In another aspect, for example, the plurality of panels can include an odd number of panels. In another aspect, for example, the plurality of panels can include 2, 3, 4, or 5 panels. In another aspect, a plurality of protrusions can connect to the panels. In still further aspects, the plurality of panels can connect to one another. In even further aspects, the panels can be connected using a plurality of living hinges. In yet further aspects, there can be a plurality of fold lines in which the living hinges may fold. In further aspects, the assembly comprises a plurality of posts connected to at least one panel. In yet further aspects, there can be a plurality of sleeves, stickers, or labels for the posts. The plurality of sleeves, stickers, or labels can be connected to the plurality of posts. In one example, 2, 3, 4, or 5 posts can be connected to one panel. In another example, 2, 3, 4, or 5 posts can be connected to two separate panels. In further aspects, a front surface of a panel, for example a display panel, can comprise a sticker or other label for indicating a desired usage of the display and/or for obscuring or otherwise limiting the viewable area through the display panel.

In one aspect, the plurality of side flaps is configured to attach, using an attaching feature, connector, or fastener, to at least one surface of a panel, wherein the side flaps are configured to retain the assembly within a display channel. In one aspect, the side flap configures to fit in the display channel. In yet further aspects, the side flap can be made from a different material than the panels. In at least one example, side flaps are fixedly attached to an end panel.

In one aspect the display assembly is configured to have a folded state and a collapsed state. In various aspects, when the display assembly is configured in a collapsed state, the plurality of panels forms a substantially planar shape. In yet another aspect, the display assembly further comprises a least one connector or fastener configured to releasably maintain at least a portion of the display assembly in a predetermined shape.

In further aspects, one or more of the plurality of panels can comprise an end panel. In yet further aspects, the end panel can be rectangular in shape. In even further aspects, the end panel contains six sides. In still other aspects, one of the panel sides connect to a living hinge. In one aspect, a plurality of posts connects to one of the middle panels. The middle panel, for example, can possess from 2 to about 10 posts, for example 3, 4, 5, 6, 7, 8, 9. In another aspect, the end panel can configure to fit in the display channel. In further aspects, the end panel configures to connect to a side flap. In yet further aspects, the plurality of protrusions can include the edge of the end panel and living hinge connect. In yet further aspects, in a folded state, the end panel is perpendicular to the middle panel. For example, a right-angle is formed by the edge of the middle panel connected to one end of the living hinge, and the edge of the end panel connected to the opposite end of the living hinge.

In further aspects, one or more of the plurality of panels can comprise a middle panel. In yet further aspects, the middle panel is rectangular in shape. In even further aspects, the middle panel contains six sides. In still other aspects, one of the panel sides connect to a living hinge. In another aspect, the middle panel has a plurality of posts connected to its largest surface area side. In another aspect, the plurality of posts connects to the middle panel. In yet another aspect, the middle panel can connect to a plurality of living hinges. In yet another aspect, the protrusions are disposed on a panel surface adjacent to a living hinge. In further aspects, in a folded state, the display panel's protrusions and the middle panel's protrusions on the "display side" of the display assembly contact one another, as to secure the display assembly in its folded state.

In further aspects, one or more of the plurality of panels can comprise a display panel. In yet further aspects, the display panel is rectangular in shape. In even further aspects, the end panel contains six sides. In still other aspects, one of the panel sides can be connected to a living hinge. In another aspect, wherein the display panel is connected to a plurality of living hinges. In yet another aspect, the plurality of protrusions can be included on the edge of the display panel and living hinge connect. In yet another aspect, wherein in a folded state, the display panel is perpendicular to the middle panel. In further aspects, in a folded state, the display panel is parallel to the end panel. In yet further aspects, in a folded state, the display panel is parallel to the plurality of posts. In yet further aspects, in a folded state, the display panel's protrusions and the post contact one another, as to hinder the further motion of the post.

In one aspect, in a folded state, the plurality of posts is parallel to the display panel and end panel. In another aspect, in a collapsed state, the plurality of posts is perpendicular to the display panel, middle panel, and end panel. In further aspects, in a collapsed state, the plurality of posts may be rotated. In yet further aspects, while in a folded state, the sides of the plurality of posts having the most surface area, is parallel and "face to face" with the display panel. In yet another aspect, the gap between the edge of the middle panel and post is a predetermined or desired distance. In yet another aspect, the gap between first edge and post is a predetermined or desired distance. In yet another aspect, the gap between individual posts is a predetermined or desired distance. In yet further aspects, on the middle panel, the gap between the end post and a middle post is a predetermined or desired distance. These gaps/distances are implemented for ease of distinction between posts and their characters attached. In further aspects, the sleeves, stickers, or labels are connected or attached to the posts.

In various aspects, the posts may be detachably connected to one or more attachment points on one more panels. In further aspects, the posts may comprise a planar display surface for displaying indicia or information to the viewer. In still further aspects, the panel may comprise a plurality of apertures for attaching on more posts in different attachment configurations. For example, a post may be attached at a first attachment position so indicia disposed on the post surface is displayed through the first portion (or left side) of the display panel when viewed by a viewer. In this arrangement, the end portion (or right side) of the display panel is available to be modified on the outside using a sticker or label. For example, the post may display numeric information related to calorie counts, and a sticker disposed on the outer display panel surface may indicate "CAL" at the right end and frame the area on the display panel corresponding to the numeric information disposed on the post. Likewise, a post may be attached at a difference attachment position so indicia disposed on the post surface is displayed through the end portion (or right side) of the display panel when viewed by a viewer. In this arrangement, the first portion (or left side) of the display panel is available to be modified on the outside using a sticker or label. For example, the post may display numeric information related to pricing data, and a sticker disposed on the outer display panel surface may indicate "$" at the first end and frame the area on the display panel corresponding to the numeric information disposed on the post surface. Accordingly, when used in conjunction with a sticker or label disposed on an outer surface of a display panel, the user can endlessly customize the type, form, and delivery of information displayed to the viewer.

In even further aspects, a plurality of protrusions is disposed on at least one surface of at least one panel, the protrusions configured to limit a range of motion of at least one living hinge. In one example, the protrusions on the end panel are located on the side of the panel which connects to the top of a "U" hinge, and where both junctions of the short edges meet the living hinge. The protrusions are located at a distance comprising 90% of the total length of the panel's short side, the distance starting at the opposite side the U hinge. In one example, the protrusions on the display panel are located on the side of the panel which connects to the top of N hinges, and where all junctions of the short edges meet the living hinge. The protrusions are located at a distance comprising 45% of the total length of the short side, the distance starting at the origin. In one example, some protrusions on the middle panel are located on the side of the panel which connects to the top of a U hinge, and where both junctions of the short edges meet the living hinge. Some other protrusions are located on the side of the panel which connects to the top of an "N" hinge. Both protrusions are located at a distance comprising 90% of the total length of the short side, the distance starting at the opposite side of their respective hinge.

In one aspect, the fold lines define each panel of the plurality of panels. In one aspect, the fold lines define at one edge of the panels. For example, the fold lines span the length of the living hinge.

In one exemplary aspect, the display assembly is molded as one piece. In another exemplary aspect, the display assembly is created by combining separate molded pieces. In yet another exemplary aspect, the posts are injection molded. In further aspects, in a folded state, the protrusions on one side of the living hinges touch the protrusions on the other side of the living hinge.

In one aspect, in the folded state, a channel is created within the living hinge. A U hinge is a living hinge that, when viewed from the side, as in FIG. 6, element 233-234, the shape of the living hinge creates a "U". An N hinge is a living hinge that, when viewed from the side, as in FIG. 6, element 231-232, the shape of the living hinge creates a "n".

The present disclosure, according to further aspects, also provides methods of using the disclosed devices and systems. In one aspect, disclosed herein is a method for displaying caloric and/or pricing information. In other aspects, the disclosed display device can be configured to display other information, for example, by using a sticker or label disposed on an outer surface of a display panel. The sticker or other label can indicate the intended usage of the display device and/or for obscuring or otherwise limiting the viewable area through the display panel. The method comprises providing a disclosed device or system and displaying caloric or pricing information using the disclosed device or system. In further aspects, the method further comprises the step of at least one of: folding the display assembly into a folded state from a collapsed state; disposing characters or indicia on a surface of at least one post, the characters or indicia relating to pricing and/or caloric information; installing the folded display assembly in a first orientation to display pricing information; installing the folded display assembly in a second orientation to display caloric information. In still further aspects, the display assembly is installed in a display channel or otherwise used in connection with a vending machine.

In further aspects, the step of disposing can comprise printing the character and/or indicia on a post surface, attaching media comprising the character and/or indicia to the post, or a combination thereof. In still further aspects, printing can comprise handwriting and/or machine-assisted methods for printing characters on a post surface. In yet further aspects, attaching can comprising a connector, slide, or other device/feature to secure the media to the post. In even further aspects, media can comprise a label, sleeve, sticker or any other medium for displaying characters and/or indicia.

According to various further aspects of the invention, the display devices and systems can comprise multiple configurations. For example, various exemplary embodiments of the inventive display devices, methods, and systems are shown in FIGS. 1-16. Hereinafter, detailed description of the various exemplary embodiments are presented with reference to the drawings.

FIG. 1 depicts a vending machine system 100 equipped with display devices 202, according to example embodiments of the present disclosure. Generally, a vending machine 102 may be positioned where consumer 112 may readily view and/or purchase food products 106 stored within enclosed space 110.

The enclosed space 110 may be a refrigerated or climate-controlled space, in some implementations. In other implementations, the enclosed space 110 may not be refrigerated, may be partially refrigerated, or may otherwise have climate control or airflow that is not necessarily refrigerated airflow.

The vending machine 102 may also have a display pane 104 allowing relatively unimpeded view of the enclosed space 110 and the food products 106 stored inside. The vending machine 102 may further include user interface 114 facilitating transactions to purchase the food products 106. Upon purchase, a selected food product 106 may be dispensed at dispensing cutout 116. The dispensing cutout 116 may include a closure flap or other features.

As described briefly above, many new guidelines for food product vending include stipulations related to the clear display of caloric or nutritional information related to each food product 106. Accordingly, according to aspects disclosed herein, a shelf 108 may include one or more display assemblies 202 arranged beneath individual food products 106. Each display assembly 202 may include food-related data displayed thereon. For example, each display assembly 202 may include indicia related to caloric, nutritional, and/or pricing information for an associated food product 106.

Figure 2:
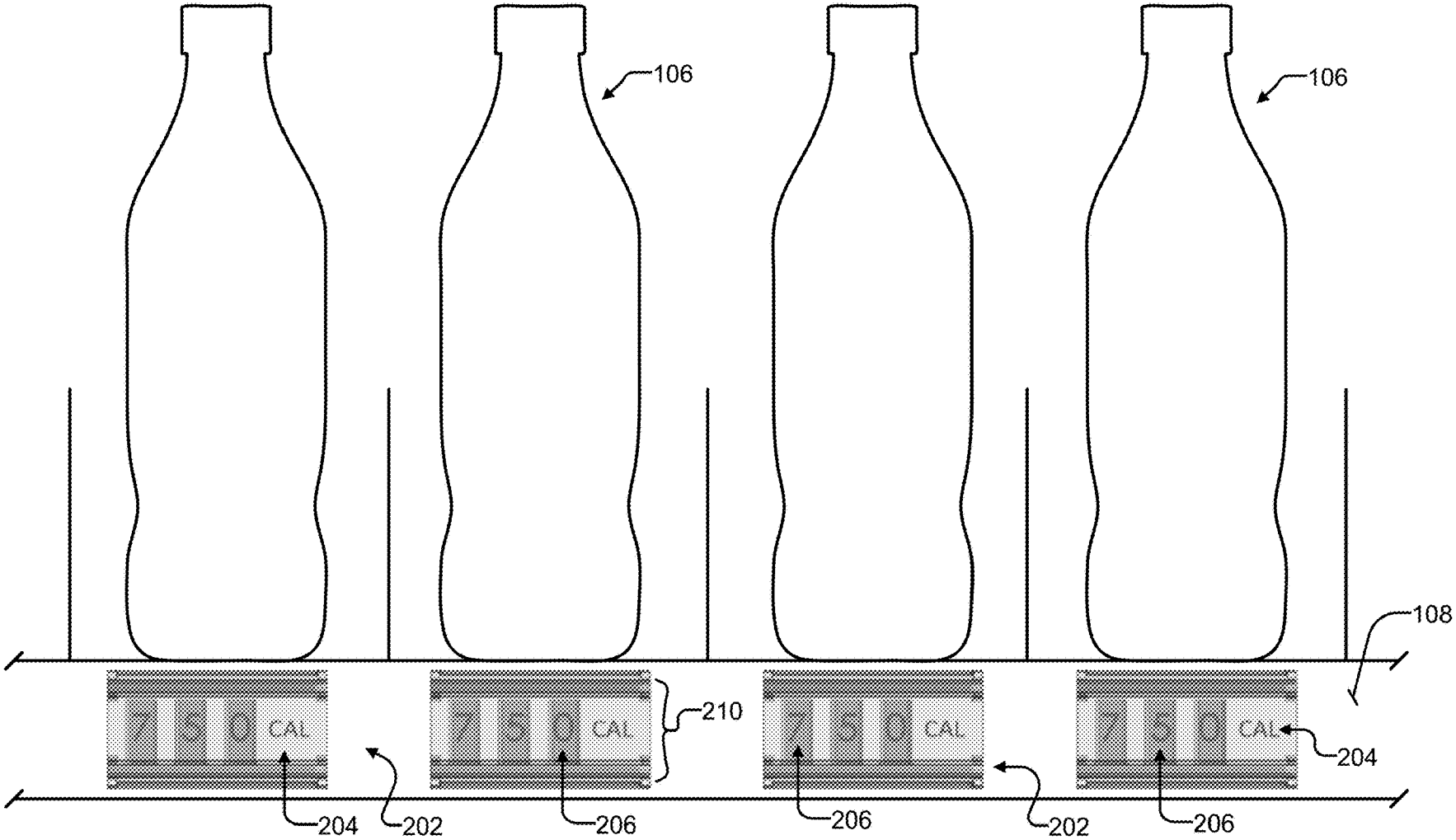
FIG. 2 is an enlarged view of a shelf of the vending machine system of FIG. 1.

FIG. 2 is an enlarged view of a shelf 108 of the vending machine system 100 of FIG. 1. As shown, food products 106 are arranged on shelf 108. Each food product 106 is associated with a display assembly 202 placed in the vicinity of a food product, for example, directly beneath a food product. The display assemblies 202 can be oriented in a first manner, as illustrated.

The display assemblies 202 may also be placed in a second orientation, rotated 180 degrees from the illustrated examples, to display, for example, pricing or other information necessitating indicia arranged to precede each numeric or indicia member 206. As shown, each display assembly 202 in the illustrated example includes caloric information and indicia 204 indicating that the indicia members 206 represent caloric information. In the second orientation, indicia 204 would represent "$" or other indicia indicating that the indicia members 206 include pricing information.

Figure 3:
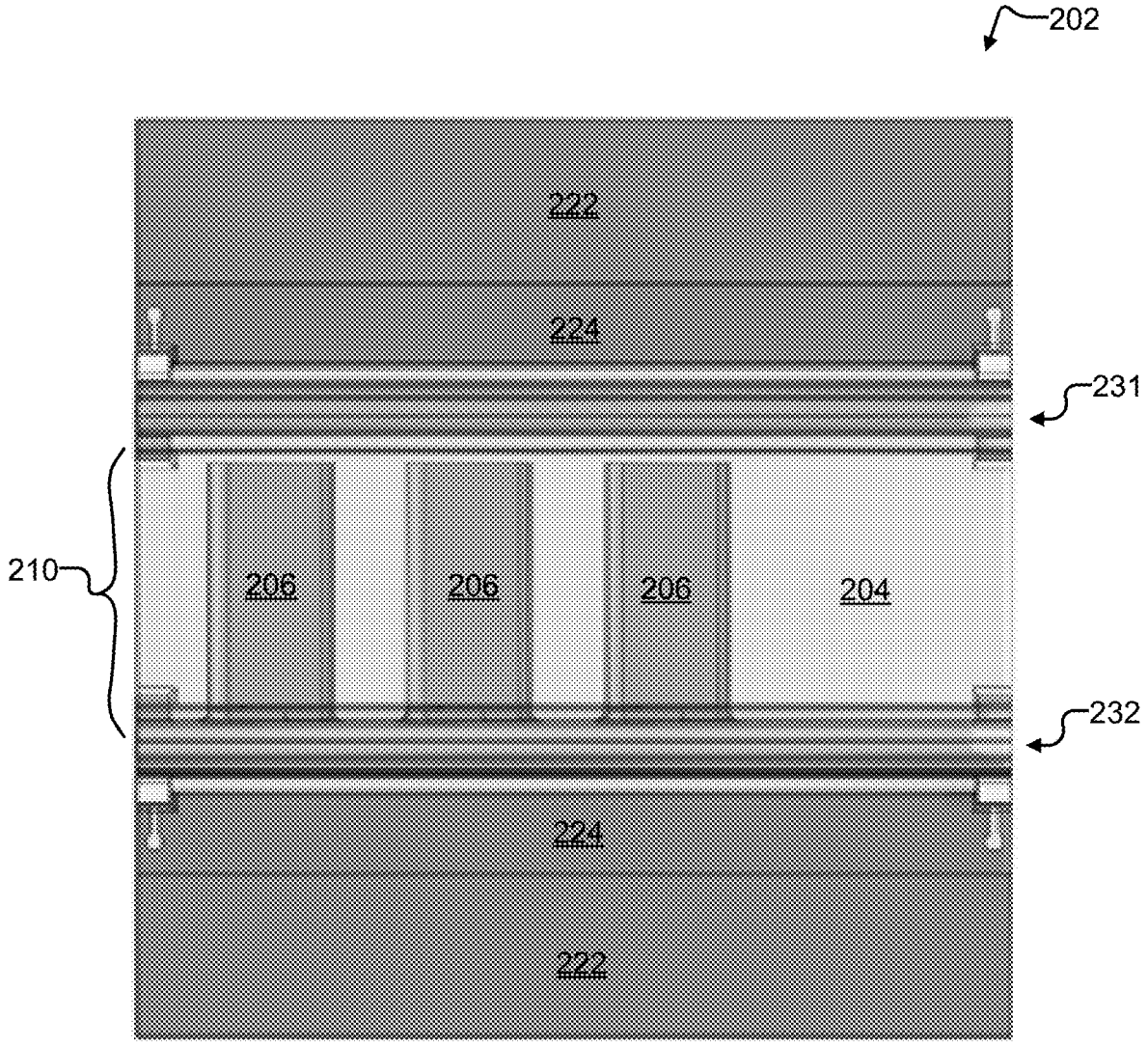
FIG. 3 depicts a display assembly in a default configuration, according to example embodiments of the present disclosure.

FIG. 3 depicts a display assembly 202 in a default configuration or first orientation, according to example embodiments of the present disclosure. As shown, the display assembly 202 includes a display panel 210. The display panel 210 is operatively attached to a first hinge 231 and a second hinge 232. The first hinge 231 is separated distally from the second hinge 232 by the height of the display panel 210. The display assembly 202 further includes end panels 224 operatively attached to engaging members or slides 222.

Generally, the slides 222 may be affixed to the end panels 224 with adhesive, pressure sensitive adhesive, glue, elastomers, tape, or other suitable fastening techniques. Furthermore, according to at least one aspect, the engaging members 222 are removably attached to the end panels 224. Still according to other aspects, the engaging members 222 are fixedly attached to the end panels 224 and are not easily removable.

Figure 4:
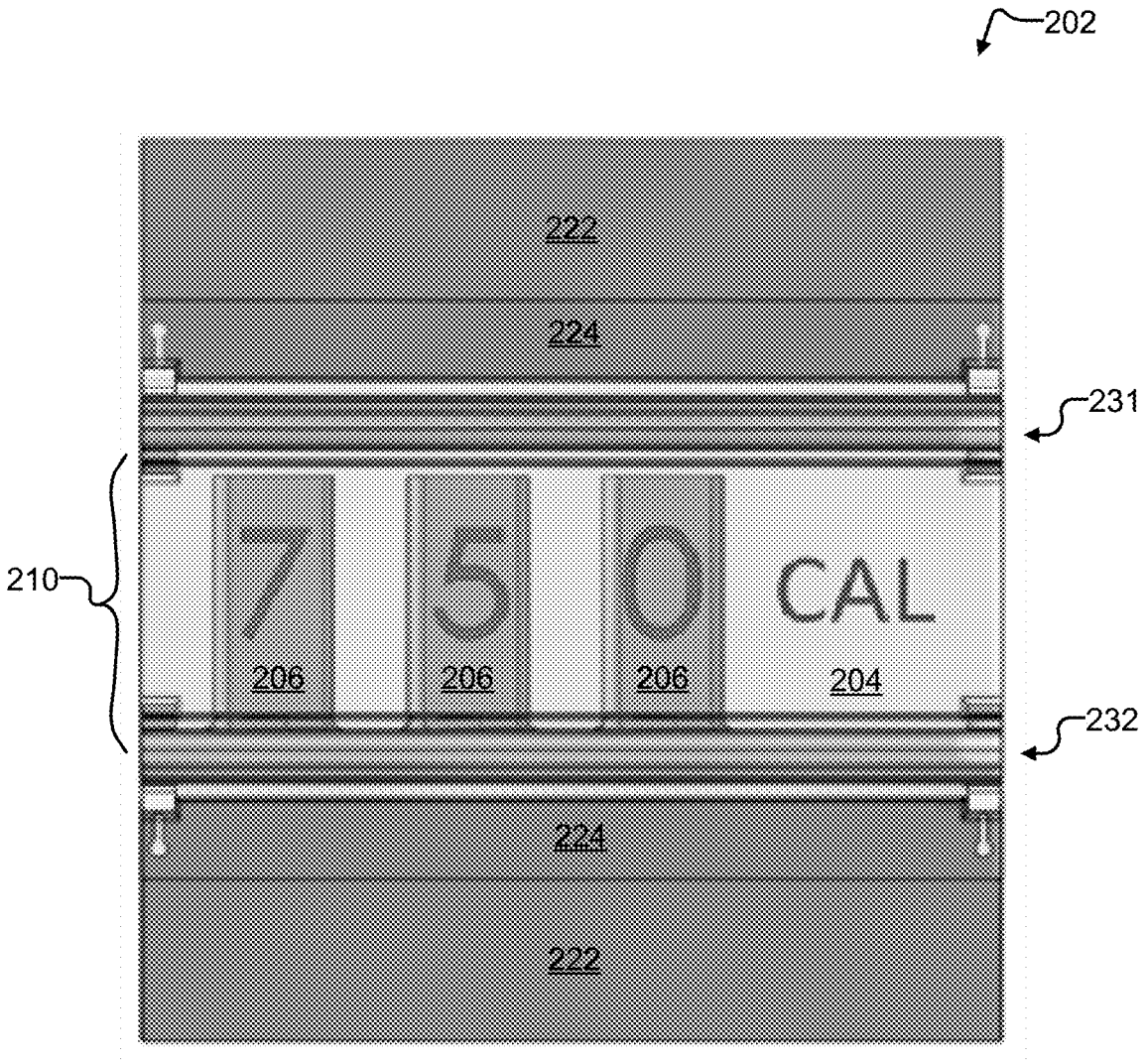
FIG. 4 depicts a display assembly having indicia displayed thereon, according to example embodiments of the present disclosure.

FIG. 4 depicts a display assembly 202 having indicia displayed thereon, according to example embodiments of the present disclosure. In contrast to FIG. 3, FIG. 4 illustrates different indicia applied to the indicia members or posts 206 and area 204 of the display panel 210. It is noted that the orientation of the display assembly 202 illustrated in FIG. 4 may be reversed into the second orientation for displaying other beneficial food product information, including pricing or other nutritional information.

Figure 5:
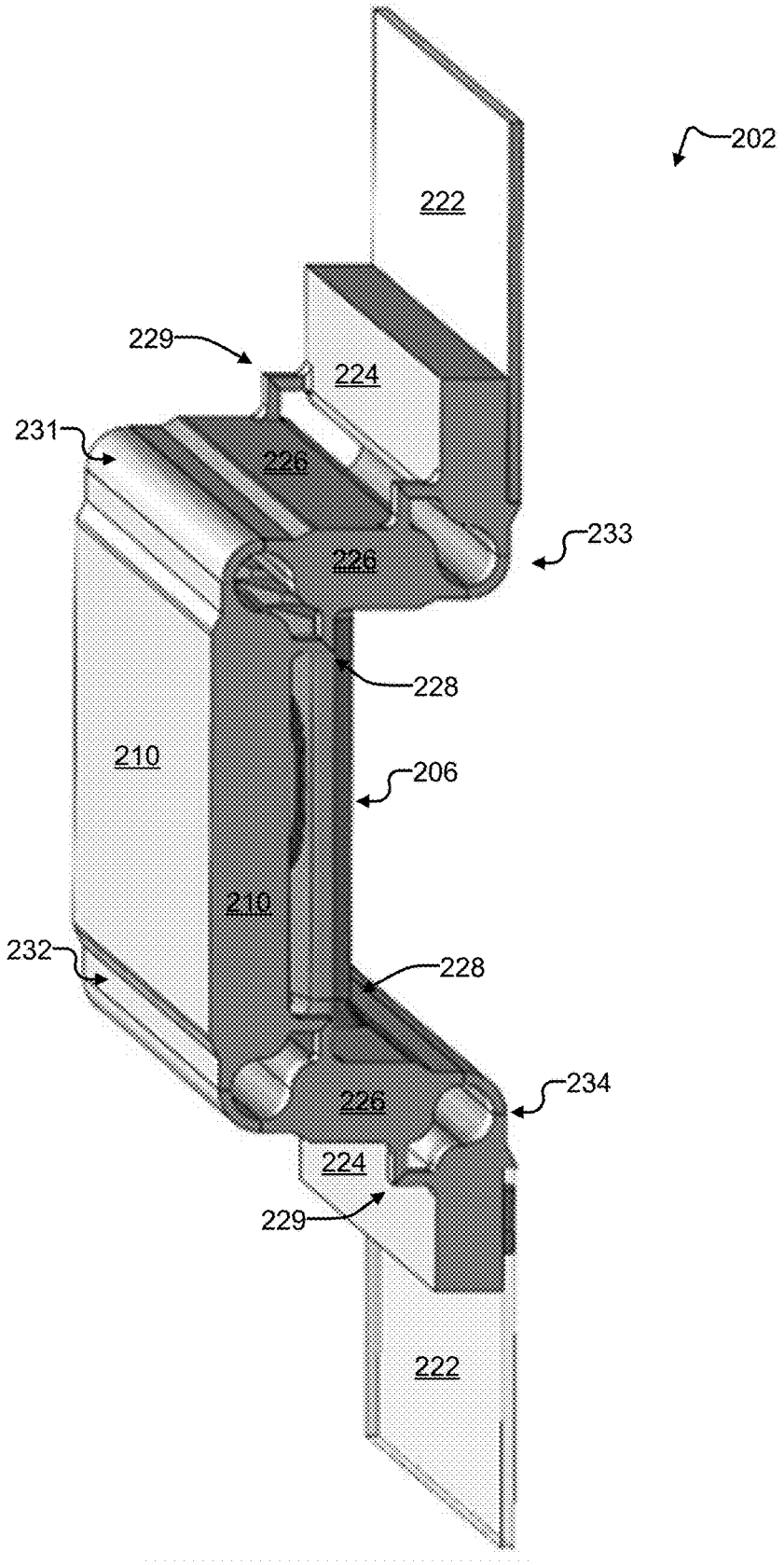
FIG. 5 is a perspective view of the display assemblies of FIG. 3 and FIG. 4, according to example embodiments of the present disclosure.

FIG. 5 is a perspective view of the display assemblies 202 of FIG. 3 and FIG. 4, according to example embodiments of the present disclosure. As shown, the display assembly 202 includes a hinged base member having display panel 210, two mid panels 226 foldably connected to the display panel 210, and two end panels 224 foldably connected to the two mid panels 226. The display panel 210 is operatively attached to a first hinge 231 and a second hinge 232.

The first hinge 231 is separated distally from the second hinge 232 by the height of the display panel 210. Furthermore, the two mid panels 226 are operatively attached to a third hinge 233 and fourth hinge 234. The first hinge 231 is separated distally from the third hinge 233 by the height of one mid panel 226. The second hinge 232 is separated distally from the fourth hinge 234 by the height of the second mid panel 226.

As illustrated, end panels 224 are operatively attached to engaging members or slides 222, the third hinge 233, and fourth hinge 234. Generally, the slides 222 may be affixed to the end panels 224 with adhesive, pressure sensitive adhesive, glue, elastomers, tape, or other suitable fastening techniques. Furthermore, according to at least one aspect, the engaging members 222 are removably attached to the end panels 224. Still according to other aspects, the engaging members 222 are fixedly attached to the end panels 224 and are not easily removable.

As further illustrated, display panel 210 and mid panels 226 have protrusions 228 extending orthogonally therefrom, about axes defined by the first hinge 231 and the second hinge 232. The axis defined by the first hinge 231 is coplanar with the display panel 210 and the mid panel 226. The axis defined by the first hinge 231 is also parallel to the slides 222. The axis defined by the second hinge 232 is coplanar with the display panel 210 and the mid panel 226. The axis defined by the second hinge 232 is also parallel to the slides 222. The protrusions 228 prevent the hinged base assembly from being folded to far inward or outward; and define a final form of the display assembly 202.

As additionally illustrated, mid panels 226 and end panels 224 have protrusions 229 extending orthogonally therefrom, about axes defined by the third hinge 233 and the fourth hinge 234. The axis defined by the third hinge 233 is coplanar with mid panel 226 and end panel 224. The axis defined by the third hinge 233 is also parallel to the slides 222. The axis defined by the fourth hinge 234 is coplanar with mid panel 226 and end panel 224. The axis defined by the fourth hinge 234 is also parallel to the slides 222. The protrusions 229 prevent the hinged base assembly from being folded to far inward or outward; and define a final form of the display assembly 202.

Furthermore, although shown as a solid panel, it is readily understood that the display panel 210 may be at least partially transparent, fully transparent, partially translucent, or otherwise capable of allowing a consumer to view the indicia members or posts 206 through the display panel 210.

Figure 6:
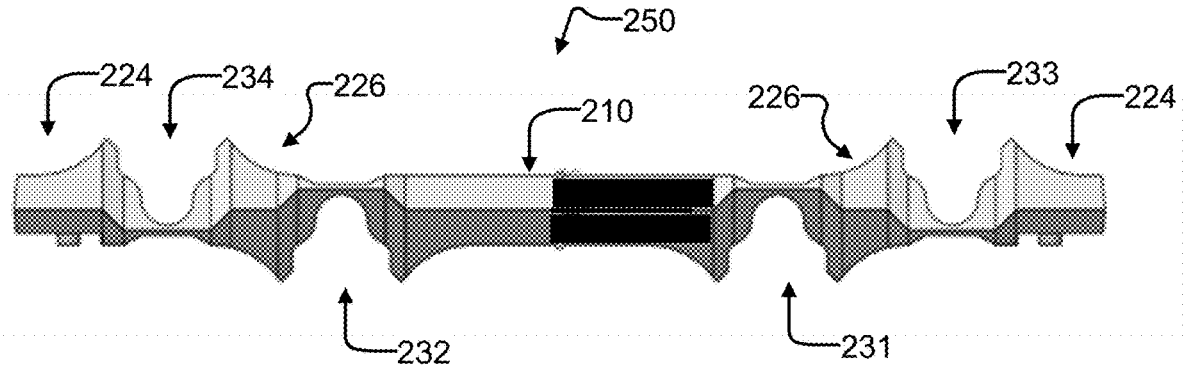
FIG. 6 is a side view of a hinged base member of a display assembly, according to example embodiments of the present disclosure.
Figure 7:
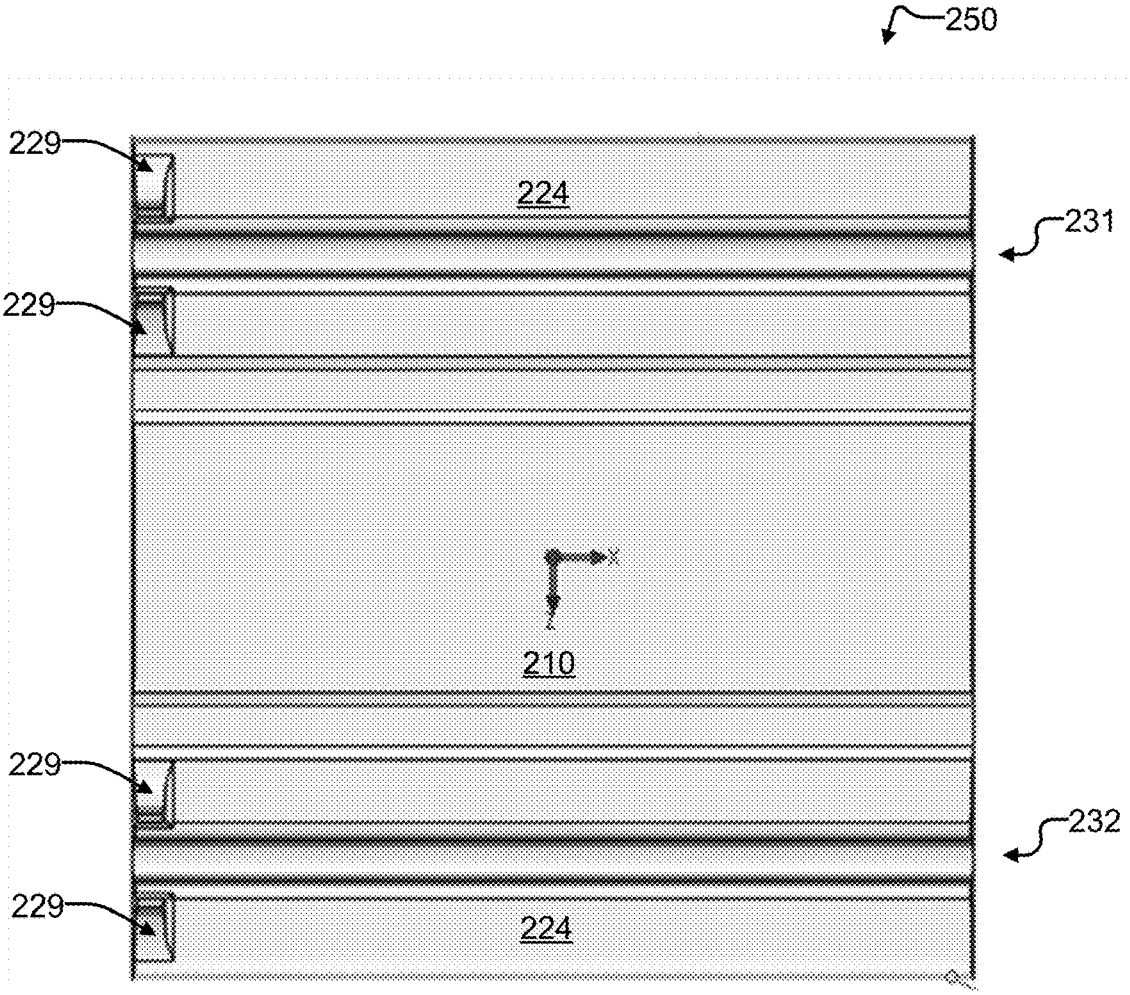
FIG. 7 is a plan view of the hinged base member of FIG. 6.

FIG. 6 is a side view of a hinged base member 250 of a display assembly 202, and FIG. 7 is a plan view of the hinged base member of FIG. 6, according to example embodiments of the present disclosure. As illustrated, the hinged base member 250 comprises the features described in detail above. Furthermore, as illustrated, protrusions 229 are arranged about the axis defined by the first hinge 231 and second hinge 232. The protrusions 229 may also be large, smaller, wider, or of different shape than those particularly illustrated.

Figure 8:
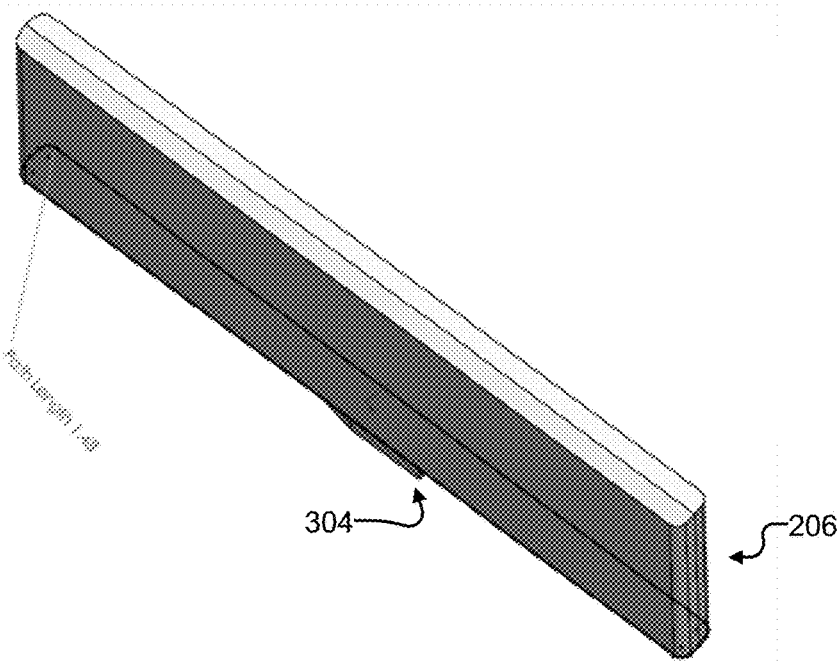
FIG. 8 is an isometric view of an indicia member of a display assembly, according to example embodiments of the present disclosure.
Figure 9:
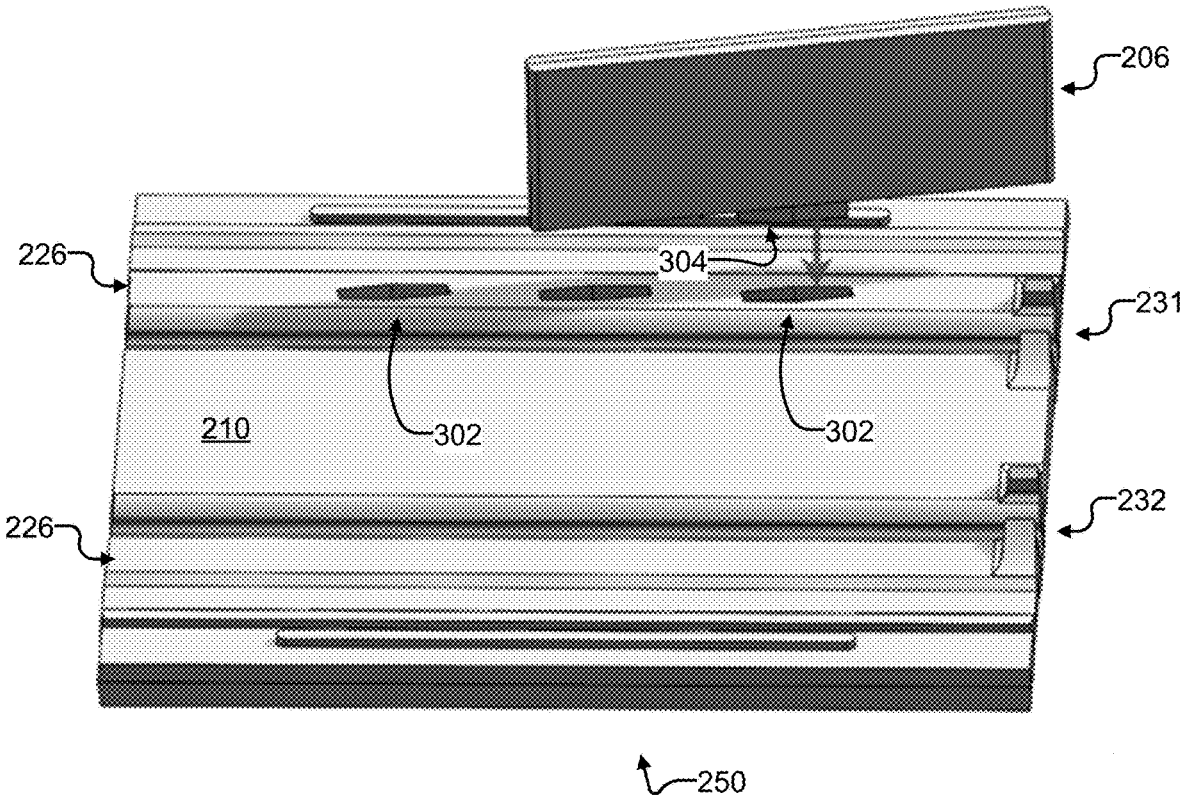
FIG. 9 is a perspective view of a partially assembled display assembly, according to example embodiments of the present disclosure.
Figure 10:
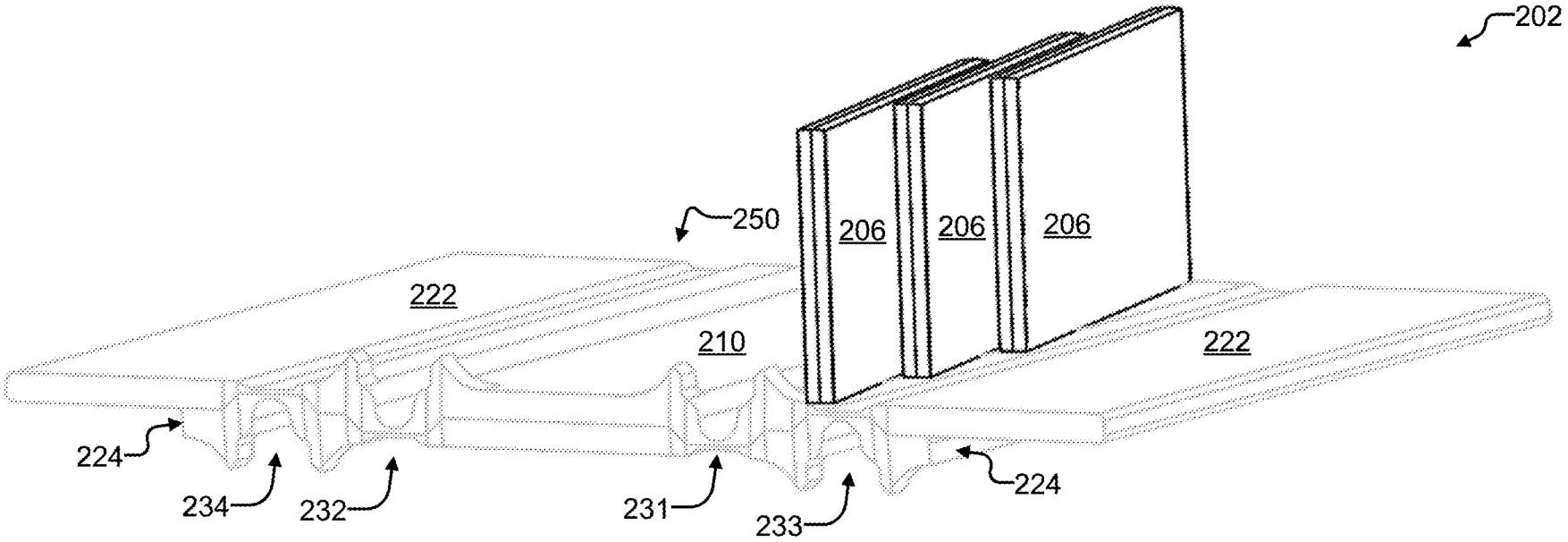
FIG. 10 is a perspective view of a partially assembled display assembly, according to example embodiments of the present disclosure.

FIG. 8 is an isometric view of an indicia member or post 206 of a display assembly, FIG. 9 is a perspective view of a partially assembled display assembly, and FIG. 10 is a perspective view of a partially assembled display assembly 202, according to example embodiments of the present disclosure. The hinged base member 250 may include slots 302 arranged on the mid panels 226. The slots 302 may be spaced equidistant from one another.

The slots 302 may be defined to receive complimentary tabs 304 protruding from indicia members 206. Additionally, the slots 302 may be slightly angled with respect to the axes defined by the first hinge 231 and the second hinge 232. In this manner, variable widths of indicia members 206 may be implemented such that the slight angle in slots 302 allows for overlap of the indicia members 206 (FIG. 10). According to some aspects, the slots 302 may be parallel to the axes defined by the first hinge 231 and second hinge 232 (FIG. 3). In this scenario, the width of the indicia members 206 may be such that they abut against each other or have a space in between each other (FIG. 3).

Generally, slots 302 may be rectangular. According to one aspect, the slots 302 may have a rectangular cross section. According to other aspects, the slots 302 may have a polygonal cross section. According to yet another aspect, the slots 302 may have a frustoconical cross section or a rhomboid cross section. Other cross sections configured to retain tabs 304 may also be implemented.

Figure 11:
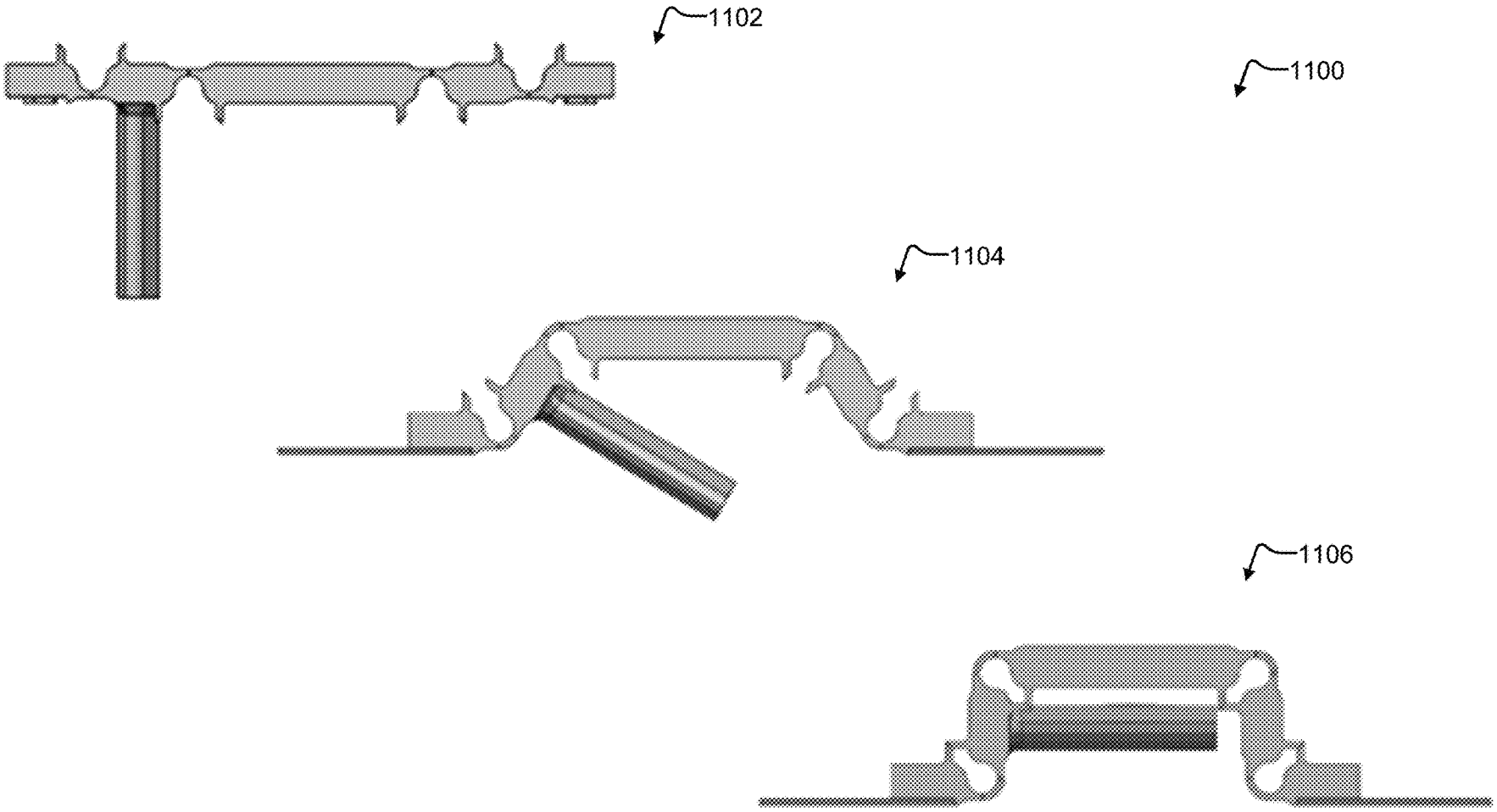
FIG. 11 illustrates a method of assembling a display assembly, according to example embodiments of the present disclosure.
Figure 12:
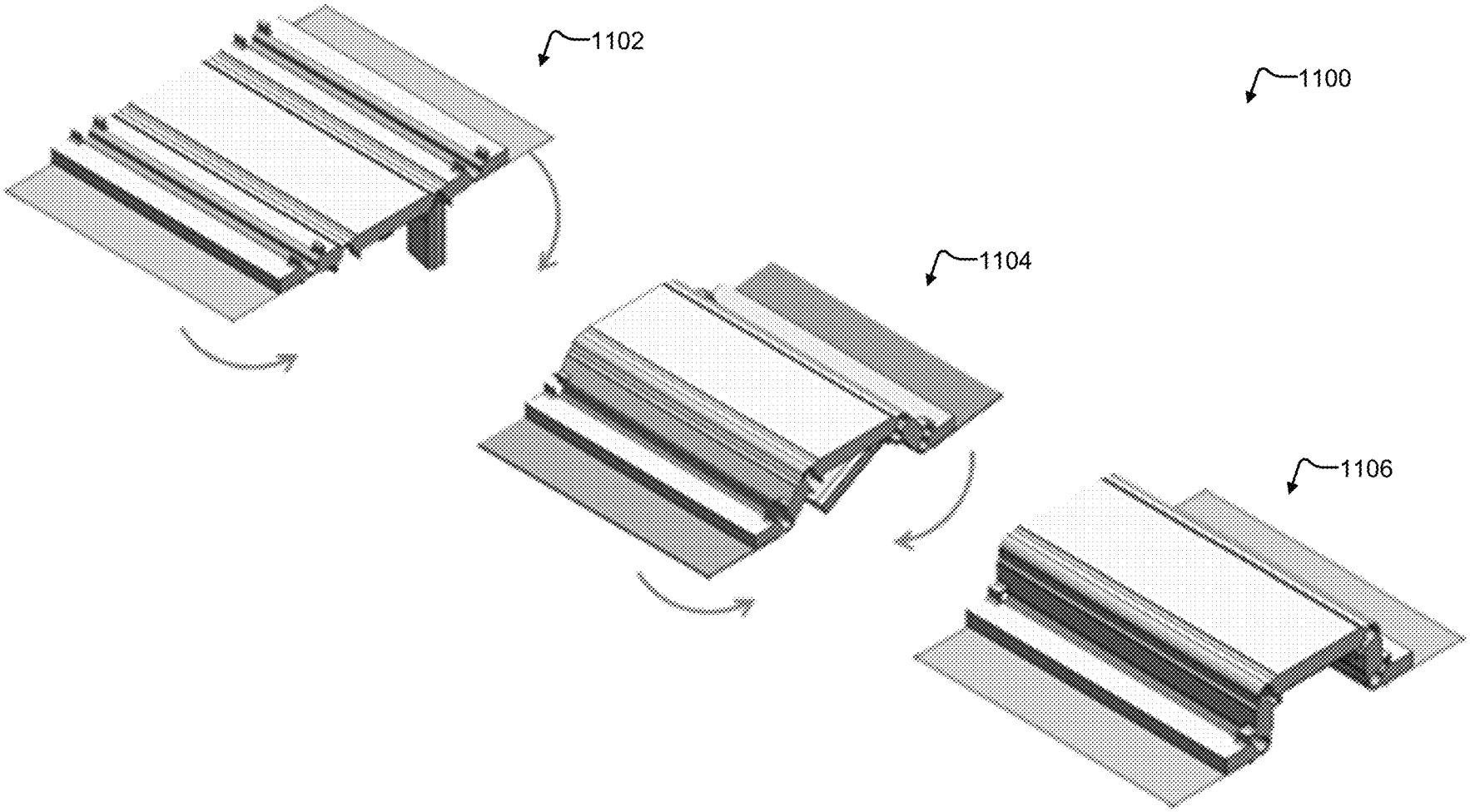
FIG. 12 illustrates a method of assembling a display assembly, according to example embodiments of the present disclosure.

FIG. 11 and FIG. 12 illustrate method 1100 of assembling a display assembly, side view and perspective views, respectively, according to example embodiments of the present disclosure. The method 1100 includes folding respective panels above the first hinge 231, second hinge 232, third hinge 233, and fourth hinge 234 as shown in steps 1102, 1104, and 1106.

It is noted that although shown as one singular motion, the folding portions may each be performed individually, in parallel, or in subsequent steps. For example, a single end panel may be folded, followed by a mid panel, and so on. Additionally, both end panels may be folded at substantially the same time, followed by any combination of folding other panels. Finally, indicia may be applied to any of the indicia members or posts 206, and/or the display panel 210.

Figure 13:
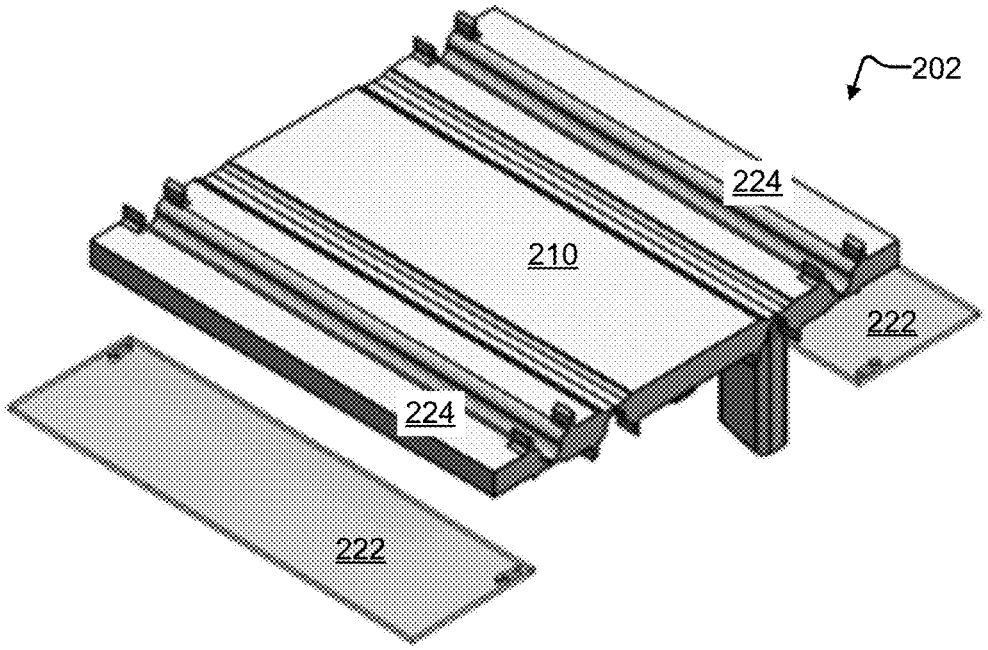
FIG. 13 is a perspective view of assembling a portion of a display assembly, according to example embodiments of the present disclosure.
Figure 14:
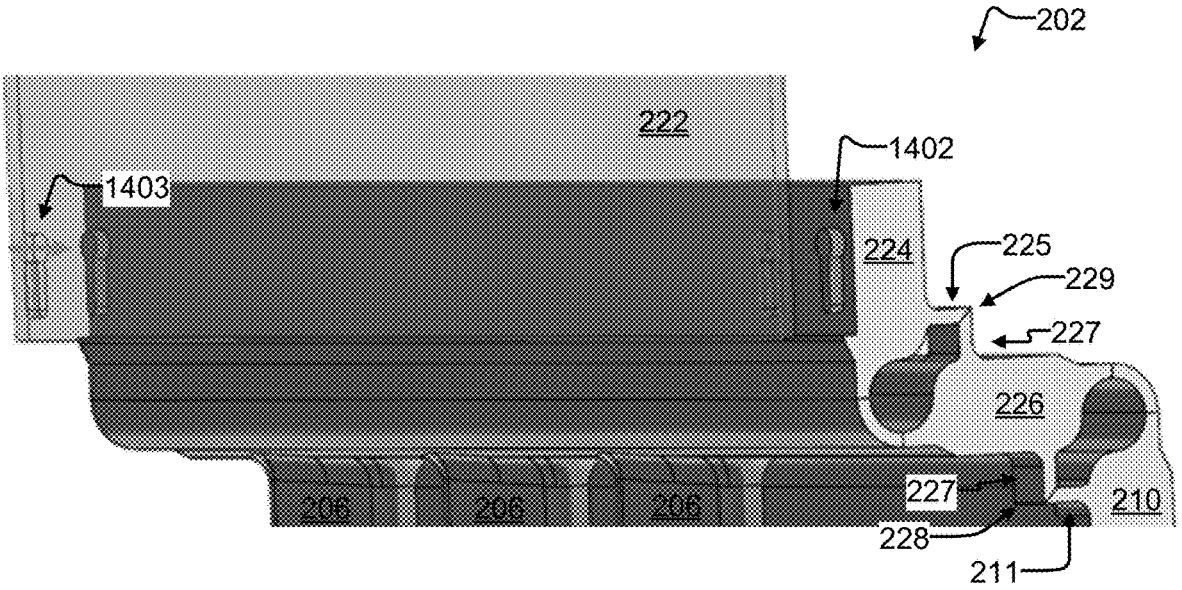
FIG. 14 is an alternate view of assembling a portion of a display assembly, according to example embodiments of the present disclosure.

Although illustrated as being applied prior to assembly in FIGS. 11-12, the slides 222 may be applied prior to assembly, after assembly, or at any intervening step. For example, FIG. 13 and FIG. 14 are perspective views of assembling a portion of a display assembly, according to example embodiments of the present disclosure. As illustrated, during application of the slides 222 to end panels 224, glue, adhesive, or other fastening features may be used to fixedly attach the slides 222 and end panels 224. Furthermore, tab 1402 on a rear face of end panel 224 may be arranged to be received within slot 1403 on a forward face of slide 222. The tab 1402 and slot 1403 may be keyhole shaped or may be shaped in any form or format desired. Furthermore, more or fewer tabs and slots may be molded onto/into end panels 224 and slides 222 to facilitate attachment. Thereafter, the entire assembly 202 may be slidably engaged into a slide channel or display channel on a forward-facing edge of a shelf 108 for holding/displaying/vending food products 106.

Figure 15:
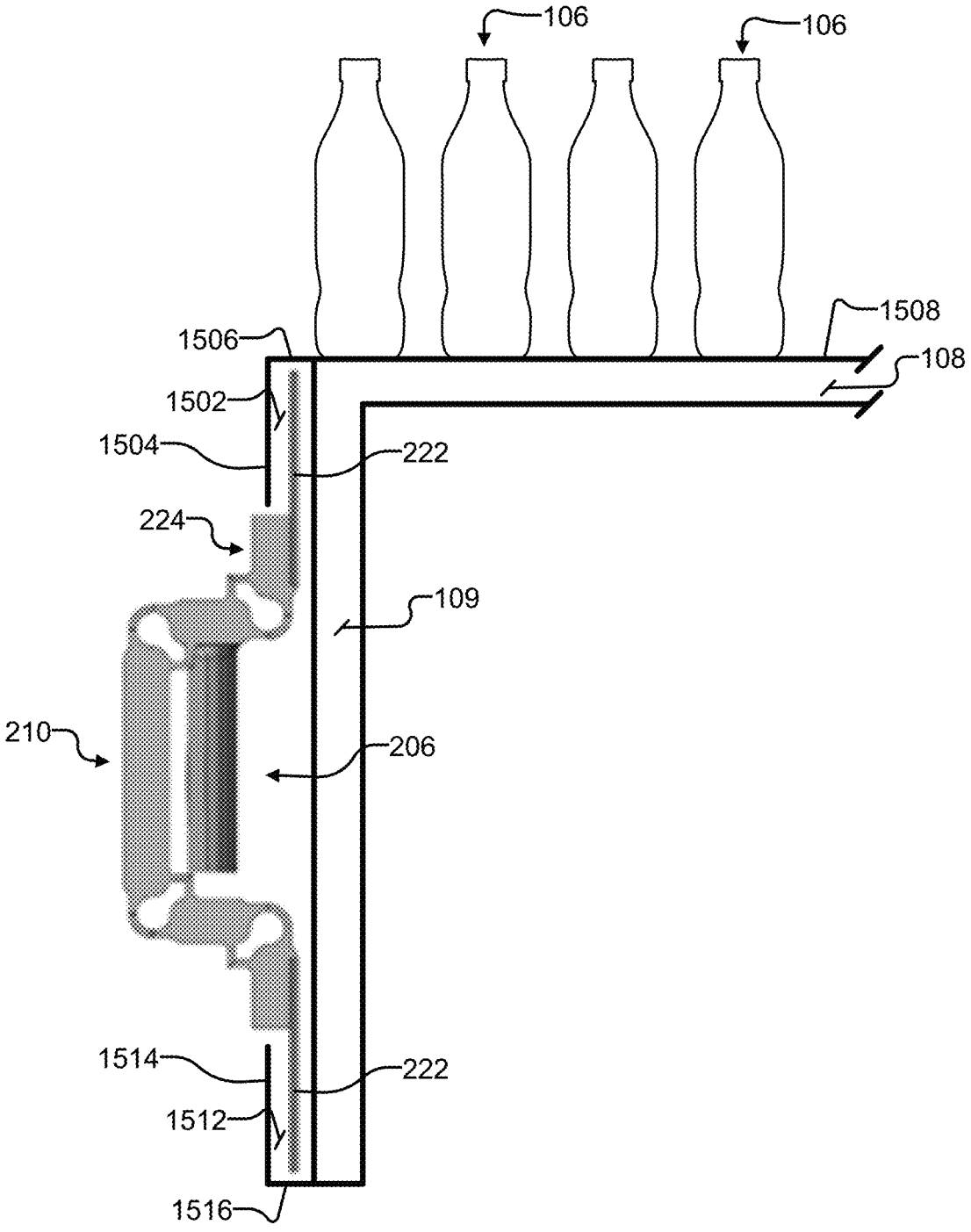
FIG. 15 is a side enlarged view of a shelf of the vending machine system of FIG. 1.

FIG. 15 is a side enlarged view of a shelf 108 of the vending machine system 100 of FIG. 1. As shown, the shelf 108 includes an upper slide channel 1502 and a lower slide channel 1512 arranged perpendicular to the upper surface 1508 of the shelf 108.

The upper slide channel 1502 includes a top edge 1506 and a forward-facing edge 1504 that define the upper slide channel 1502. The upper slide channel 1502 is configured to slidably engage with slides 222 of a display assembly 202. Dimensionally, the upper slide channel 1502 may "squeeze" or otherwise cause friction serving to retain a slide 222 in a position until moved by a user.

The lower slide channel 1512 includes a bottom edge 1516 and a forward-facing edge 1514 that define the lower slide channel 1512. The lower slide channel 1512 is configured to slidably engage with slides 222 of a display assembly 202. Dimensionally, the lower slide channel 1512 may "squeeze" or otherwise cause friction serving to retain a slide 222 in a position until moved by a user.

As described in detail above, in a first orientation, in the display assembly's folded state, the posts display caloric information. In a second orientation, in the display assembly's folded state, the posts display pricing information. In one setup, in the display assembly's folded state, the slides 222 and/or end panels 224 attach to a display channel 1502, 1512 in a vending machine 102. In another setup, in the display assembly's folded state, the display assembly utilizes connected flaps or other features to attach to the display channel in a vending machine.

Figure 16:
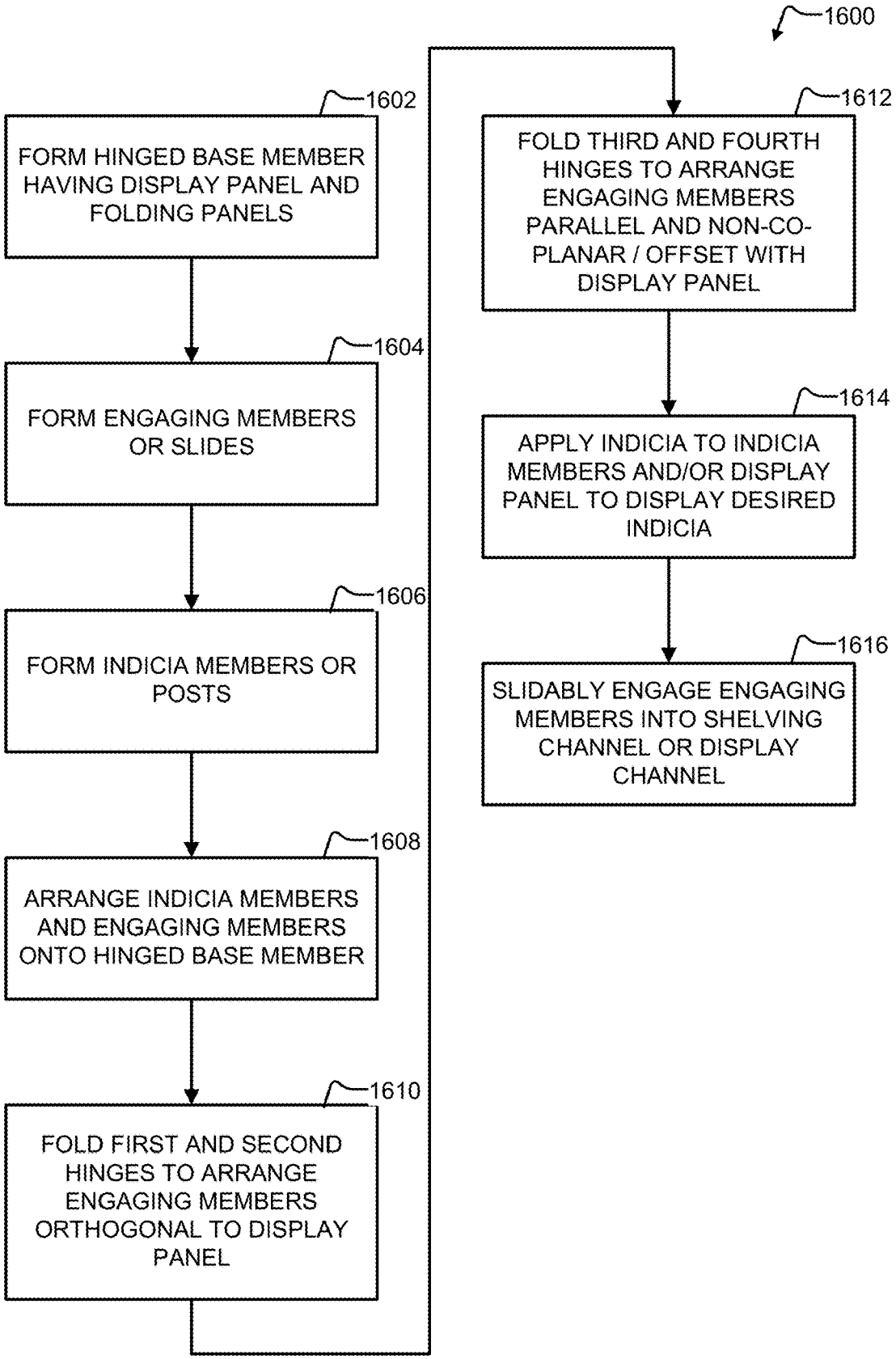
FIG. 16 is a flowchart of a method of producing a display assembly, according to example embodiments of the present disclosure.

Hereinafter, methods of producing display assemblies are described in detail with reference to FIG. 16. FIG. 16 is a flowchart of a method 1600 of producing a display assembly 202, according to example embodiments of the present disclosure.

The method 1600 includes forming a hinged base member, at block 1602. Generally, the hinged base member 250 may be injection molded, 3D printed, additive or subtractive printed, machined, or otherwise formed from a suitable material. Suitable materials include plastics, elastomers, paperboard, cardstock, or any material capable of having a relatively transparent display panel 210 molded or formed therein. The display panel 210 may be formed of a same material (e.g., clear injection molded plastic) or may be formed of a different material (e.g., plastic film applied onto paperboard) as the remaining panels of the hinged base member.

The method 1600 further includes forming engaging members or slides, at block 1604. The engaging members or slides 222 may be formed of any material suitable to slidably engage with display or slide channels 1502, 1512 of the shelf 108. Suitable materials include plastic, metal, paper, paperboard, cardstock, or other suitable materials.

The method 1600 further includes forming indicia members or posts, at block 1606. The indicia members or posts 206 may be formed of any material suitable to receive indicia and display the same beneath display panel 210. Suitable materials include plastic, metal, paper, paperboard, cardstock, or other suitable materials.

The method 1600 further includes arranging the indicia members and the engaging members onto the hinged base member, at block 1608. For example, FIGS. 8-9 illustrate arrangement of indicia members or posts 206 onto hinged base member 250. Furthermore, FIGS. 13-14 illustrate arrangement of slides or engaging members 222 onto hinged base member 250.

The method 1600 further includes folding first and second hinges to arrange engaging members orthogonal to the display panel, at block 1610. The method 1600 further includes folding third and fourth hinges to arrange engaging members to be parallel and non-coplanar with the display panel, at block 1612. Blocks 1610 and 1612 are illustrated in FIGS. 11-12.

The method 1600 further includes applying indicia to the indicia members and/or display panel, at block 1614. Indicia displayed in FIG. 4 generally represents basic indicia and arrangements of indicia for display members 202. It is readily understood that any applicable or suitable indicia may be applied to the indicia members 206 and/or display panel 210, according to any desired result. Permanent or non-permanent ink, stickers, appliques, chalk, carbon, graphite, or any marking implement may be used to apply permanent or non-permanent indicia. Furthermore, indicia (e.g., non-permanent indicia) may be re-applied as desired or changed regularly. Accordingly, display assemblies according to this disclosure allow for adding any suitable information as required by guidelines or regulations in dispensing, vending, or selling of food products.

The method 1600 also includes slidably engaging the engaging members 222, and therefore the entire display assembly 202, into a shelving channel 1502, 1512 or display channel of shelf 108, at block 1616. For example, FIG. 15 illustrates a suitably engaged display assembly and shelf.

As described in detail herein, the present disclosure includes a plurality of aspects, including, but not limited to, the following example aspects:

Aspect 1 includes a display device having a collapsible display assembly, the assembly comprising: a plurality of panels having a predetermined area and thickness, the plurality of panels connected with living hinges; a plurality of posts connected to at least one panel of the plurality of panels; one or more protrusions disposed on at least one surface of at least one panel, the one or more protrusions configured to limit a range of motion of at least one living hinge of the living hinges.

Aspect 2 includes the display device of any preceding aspect, wherein the plurality of panels comprises a display panel, the display panel being rectangular in shape, the display panel containing six sides, and wherein two of the six sides of the display panel each being operatively attached to a living hinge.

Aspect 3 includes the display device of any preceding aspect, wherein the plurality of panels comprises one or more mid panels, and wherein at least one mid panel has a plurality of posts connected to its largest surface area side.

Aspect 4 includes the display device of any preceding aspect, further comprising one or more slides configured to attach, using an attachment feature, to at least one surface of a panel of the plurality of panels, wherein the one or more slides are configured to retain the device within a display channel.

Aspect 5 includes the display device of any preceding aspect, wherein the plurality of panels comprises at least one transparent rectangular display panel.

Aspect 6 includes the display device of any preceding aspect, wherein the living hinges each define a hinge axis parallel to a plane formed from each panel of the plurality of panels.

Aspect 7 includes the display device of any preceding aspect, wherein the living hinges define fold lines between at least two panels of the plurality of panels.

Aspect 8 includes the display device of any preceding aspect, wherein the collapsible display assembly is configured to have a folded state and a collapsed state.

Aspect 9 includes the display device of any preceding aspect, wherein when the collapsible display assembly is configured collapsed, the plurality of panels forms a substantially planar shape.

Aspect 10 includes the display device of any preceding aspect, further comprising a least one connector configured to releasably maintain a least a portion of the display assembly in a predetermined shape.

Aspect 11 includes the display device of any preceding aspect, wherein the display assembly is a single piece of material.

Aspect 12 includes the display device of any preceding aspect, wherein the single piece of material is an injection molded plastic.

Aspect 13 includes the display device of any preceding aspect, wherein the plurality of posts are injection molded plastic.

Aspect 14 includes the display device of any preceding aspect, wherein the one or more protrusions extend orthogonally from at least one panel, and wherein the one or more protrusions are configured to abut against another protrusion to limit range of motion of the living hinges.

Aspect 15 includes a food product vending system, comprising: a vending machine, the vending machine comprising one or more shelves disposed within a refrigerated space interior to the vending machine, the one or more shelves configured to support various food products, the one or more shelves comprising a display channel defined on a forward-facing edge of the one or more shelves, the display channel configured to display and retain a display device, and the display device comprising: a hinged base member having a display panel formed of an at least partially transparent material; at least one indicia member disposed behind the display panel, the at least one indicia member configured to display indicia through the display panel; and at least one engaging member operatively connected to the display panel and the at least one indicia member, the at least one engaging member configured to slidably engage with a display channel of a vending machine associated with a food product.

Aspect 16 includes the food product vending system of any preceding aspect, wherein the hinged base member further comprises at least one mid panel foldably connected to the display panel, the at least one mid panel configured to retain the at least one indicia member behind the display panel.

Aspect 17 includes the food product vending system of any preceding aspect, wherein the hinged base member further comprises at least one end panel foldably connected to the at least one mid panel, the at least one end panel configured to retain the at least one engaging member.

Aspect 18 includes the food product vending system of any preceding aspect, wherein the display panel, the at least one mid panel, and the at least one end panel each comprise one or more protrusions configured to retain the hinged base member in an appropriate folded state for display of the at least one indicia member.

Aspect 19 includes a method of forming a display device, the method comprising: forming a hinged base member having an at least partially transparent display panel; forming at least one indicia member configured to display indicia through the display panel; forming at least one engaging member configured to slidably engage with a display channel of a vending machine associated with a food product; arranging the at least one indicia member and the at least one engaging member onto the hinged base member; and folding the hinged base member to form a display assembly.

Aspect 20 includes the method of any preceding aspect, wherein arranging the at least one indicia member and the at least one engaging member comprises fixedly attaching the at least one indicia member and the at least one engaging member to the hinged base member using adhesive or glue.

Aspect 21 includes the device of any preceding aspect, wherein in a folded state, the plurality of posts is parallel to the display panel and end panel.

Aspect 22 includes the device of any preceding aspect, wherein in a collapsed state, the plurality of posts is perpendicular to the display panel, middle panel, and end panel.

Aspect 23 includes the device of any preceding aspect, wherein in a collapsed state, the plurality of posts may be rotated.

Aspect 24 includes the device of any preceding aspect, wherein while in a folded state, a face of the plurality of posts having the most surface area is parallel and "face to face" with the display panel.

Aspect 25 includes the device of any preceding aspect, wherein the display assembly comprises a gap or space between the edge of the middle panel and post is a predetermined distance (gap between first edge and post . . . predetermined distance).

Aspect 26 includes the device of any preceding aspect, wherein on the middle panel, the gap between the end post and a middle post is a predetermined distance.

Aspect 27 includes the device of any preceding aspect, wherein a plurality of posts is connected to one or more middle panels.

Aspect 28 includes the device of any preceding aspect, wherein the end panel is configured to fit in a display channel.

Aspect 29 includes the device of any preceding aspect, wherein an end panel is configured to connect to the side flap.

Aspect 30 includes the device of any preceding aspect, wherein the side flap is made from a different material than the panels.

Aspect 31 includes the device of any preceding aspect, wherein the side flap is configured to fit in the display channel.

Aspect 32 includes the device of any preceding aspect, wherein a cavity is created between panels when in a folded state.

Aspect 33 includes the device of any preceding aspect, wherein the plurality of protrusions can be included on the edge of the end panel and living hinge connect.

Aspect 34 includes the device of any preceding aspect, wherein in a folded state, the end panel is perpendicular to the middle panel.

Aspect 35 includes the device of any preceding aspect, wherein the plurality of posts connects to the middle panel, for example, the middle panel can possess from 2 to about 10 posts, for example 3, 4, 5, 6, 7, 8, or 9 posts.

Aspect 36 includes the device of any preceding aspect, wherein the middle panel is connected to a plurality of living hinges.

Aspect 37 includes the device of any preceding aspect, wherein the protrusions are disposed on a panel surface adjacent to a living hinge.

Aspect 38 includes the device of any preceding aspect, wherein in a folded state, the display panel's protrusions and the middle panel's protrusions on the "Display side" of the display assembly contact one another, as to secure the display assembly in its folded state.

Aspect 39 includes the device of any preceding aspect, wherein the display panel is connected to a plurality of living hinges.

Aspect 40 includes the device of any preceding aspect, wherein the plurality of protrusions can be included on the edge of the display panel and living hinge connect.

Aspect 41 includes the device of any preceding aspect, wherein in a folded state, the display panel is perpendicular to the middle panel.

Aspect 42 includes the device of any preceding aspect, wherein in a folded state, the display panel is parallel to the end panel.

Aspect 43 includes the device of any preceding aspect, wherein in a folded state, the display panel is parallel to the plurality of posts.

Aspect 44 includes the device of any preceding aspect, wherein in a folded state, the display panel's protrusions and the post contact one another, as to hinder the further motion of the post.

Aspect 45 includes the device of any preceding aspect, wherein in the folded state, a cavity or interior space is created within the living hinge.

Aspect 46 includes the device of any preceding aspect, wherein the display panel is connected to one side of the living hinge, and the middle panel is connected to the other side of the hinge.

Aspect 47 includes the device of any preceding aspect, wherein in a folded state, the protrusions on one side of the living hinges touch the protrusions on the other side of the living hinge.

Aspect 48 includes the device of any preceding aspect, wherein the at least one post is detachably attached to at least one panel.

Aspect 49 includes the device of any preceding aspect, wherein the at least one post is configured to detachably attached to one or more attachment point disposed on a panel surface.

Aspect 50 includes a method for displaying caloric and/or pricing information, the method comprising the steps of providing the device of any preceding claim; and displaying information using the device.

Aspect 51 includes the method of any preceding aspect, wherein the information comprises at least one of caloric information, pricing information, product information, or the like.

Aspect 52 includes the method of any preceding aspect, further comprising the step of at least one of: folding the display assembly into a folded state from a collapsed state; disposing characters or indicia on a surface of at least one post, the characters or indicia relating to pricing and/or caloric information; installing the folded display assembly in a first orientation to display pricing information; installing the folded display assembly in a second orientation to display caloric information; and disposing a sticker or label on an outer surface of a display panel to modify a view through the display panel and/or provide additional information related to information displayed on a post surface.

Aspect 53 includes the method of any preceding aspect, wherein the display assembly is installed in a display channel or otherwise used in connection with a vending machine.

Aspect 54 includes the method of preceding aspect, wherein the step of disposing can comprise printing the character and/or indicia on a post surface, attaching media comprising the character and/or indicia to the post, or a combination thereof.

Aspect 55 includes the method of any preceding aspect, wherein printing can comprise handwriting and/or machine-assisted methods for printing characters on a post surface.

Aspect 56 includes the method of any preceding aspect, wherein attaching comprises a connector, slide, or other feature to secure the media to the post.

Aspect 57 includes the method of any preceding aspect, wherein media can comprise a label, sleeve, sticker or any other medium for displaying characters and/or indicia.

Aspect 58 includes the display device of aspect 1, wherein the plurality of panels comprises a display panel, the display panel having a polygonal shape, the display panel containing two sides each being operatively attached to a living hinge.

Aspect 59 includes the display device of aspect 58, wherein the display panel is rectangular and/or square in shape.

Aspect 60 includes the display device of aspect 58 or 59, wherein the display panel contains six sides, wherein two of the six sides of the display panel each being operatively attached to a living hinge.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A display device having a collapsible display assembly, the assembly comprising:

a plurality of panels having a predetermined area and thickness, the plurality of panels connected with living hinges;

one or more posts connected to at least one panel of the plurality of panels, the plurality of panels comprising a display panel and one or more mid panels, the display panel having a polygonal shape and containing two sides each being operatively attached to a living hinge, and at least one mid panel having at least one post of said one or more posts connected to its largest surface area side;

one or more protrusions disposed on at least one surface of at least one panel of the plurality of panels, the one or more protrusions configured to limit a range of motion of at least one living hinge of the living hinges; and one or more slides configured to attach, using an attachment feature, to at least one surface of a panel of the plurality of panels, wherein the one or more slides are configured to retain the device within a display channel;

wherein the living hinges define fold lines between at least two panels of the plurality of panels;

wherein the collapsible display assembly is configured to have a folded state and a collapsed state, the plurality of panels forming a substantially planar shape when the collapsible display assembly is configured in the collapsed state.

2. The display device of claim 1, wherein the display panel comprises at least one transparent display panel having a rectangular or square shape.

3. The display device of claim 1, wherein the living hinges each define a hinge axis parallel to a plane formed from each panel of the plurality of panels.

4. The display device of claim 1, further comprising a least one connector configured to releasably maintain a least a portion of the display assembly in a predetermined shape.

5. The display device of claim 4, wherein the display assembly is a single piece of material.

6. The display device of claim 5, wherein the single piece of material is an injection molded plastic.

7. The display device of claim 6, wherein the plurality of posts are injection molded plastic.

8. The display device of claim 5, wherein the one or more protrusions extend orthogonally from at least one panel, and wherein the one or more protrusions are configured to abut against another protrusion to limit range of motion of the living hinges.

9. A food product vending system, comprising:

a vending machine, the vending machine comprising one or more shelves disposed within a refrigerated space interior to the vending machine, the one or more shelves configured to support various food products, the one or more shelves comprising a display channel defined on a forward-facing edge of the one or more shelves, the display channel configured to display and retain a display device, and the display device comprising:

a hinged base member having a display panel formed of an at least partially transparent material and at least one mid panel foldably connected to the display panel;

at least one indicia member disposed behind the display panel, the at least one indicia member configured to display indicia through the display panel; and at least one engaging member operatively connected to the display panel and the at least one indicia member, the at least one engaging member configured to slidably engage with a display channel of a vending machine associated with a food product;

wherein the display device is configured to have a folded state and a collapsed state, the display panel and the at least one mid panel forming a substantially planar shape when the display device is configured in the collapsed state.

10. The food product vending system of claim 9, wherein the hinged base member further comprises at least one mid panel foldably connected to the display panel, the at least one mid panel is configured to retain the at least one indicia member behind the display panel.

11. The food product vending system of claim 10, wherein the hinged base member further comprises at least one end panel foldably connected to the at least one mid panel, the at least one end panel configured to retain the at least one engaging member.

12. The food product vending system of claim 11, wherein the display panel, the at least one mid panel, and the at least one end panel each comprise one or more protrusions configured to retain the hinged base member in the folded state for display of the at least one indicia member.

13. The food product vending system of claim 12, wherein each of the one or more protrusions extend orthogonally, and wherein the one or more protrusions are configured to abut against another protrusion to limit range of motion.

14. The food product vending system of claim 9, wherein the display device is a single piece of material.

15. The food product vending system of claim 14, wherein the single piece of material is an injection molded plastic.

16. A display device having a collapsible display assembly, the assembly comprising:

a plurality of panels having a predetermined area and thickness, the plurality of panels connected with living hinges;

one or more posts connected to at least one panel of the plurality of panels, the plurality of panels comprising a display panel and one or more mid panels, the display panel operatively attached to a living hinge, and at least one mid panel having at least one post of said one or more posts;

one or more protrusions disposed on at least one surface of at least one panel, the one or more protrusions configured to limit a range of motion of at least one living hinge of the living hinges;

wherein the collapsible display assembly is configured to have a folded state and a collapsed state, the plurality of panels forming a substantially planar shape when the collapsible display assembly is configured in the collapsed state.

17. The display device of claim 16, further comprising one or more slides configured to attach, using an attachment feature, to at least one surface of a panel of the plurality of panels, wherein the one or more slides are configured to retain the device within a display channel.

18. The display device of claim 16, wherein the display panel comprises at least one transparent display panel having a rectangular or square shape.

19. The display device of claim 16, wherein the living hinges each define a hinge axis parallel to a plane formed from each panel of the plurality of panels.

20. The display device of claim 16, wherein the living hinges define fold lines between at least two panels of the plurality of panels.

* * * * *